US005280252A

United States Patent [19]

Inoue et al.

[11] Patent Number: 5,280,252

[45] Date of Patent: Jan. 18, 1994

[54] CHARGED PARTICLE ACCELERATOR

[75] Inventors: Ken-ichi Inoue; Akira Kobayashi; Takuya Kusaka; Yutaka Kawata, all of Kobe; Kouji Inoue, Tokyo; Kiyotaka Ishibashi, Kobe; Yukito Furukawa, Tsukuba; Toshiji Suzuki; Tetsuo Tokumura, both of Kobe; Mitsuo Terada, Fujiidera, all of Japan

[73] Assignee: Kabushiki Kaisha Kobe Seiko Sho, Kobe, Japan

[21] Appl. No.: 766,410

[22] Filed: Sep. 27, 1991

[30] Foreign Application Priority Data

May 21, 1991 [JP] Japan ..... 3-116174

[51] Int. Cl.[5] ..... H05H 7/00

[52] U.S. Cl. ..... 328/233; 313/359.1; 315/5.41; 315/5.42; 315/5.49

[58] Field of Search ..... 328/233; 313/359.1; 315/5.41, 5.42, 5.43, 5.49

[56] References Cited

U.S. PATENT DOCUMENTS

| | | | |
|---|---|---|---|
| 4,801,847 | 1/1989 | Sakudo et al. | 315/5.42 |
| 4,992,744 | 2/1991 | Fujita et al. | 328/233 |

FOREIGN PATENT DOCUMENTS

| | | | |
|---|---|---|---|
| 0163745 | 12/1985 | European Pat. Off. . | |
| 197843 | 10/1986 | European Pat. Off. . | |
| 0280044 | 8/1988 | European Pat. Off. . | |
| 2081502 | 2/1982 | United Kingdom . | |
| 2183087 | 5/1987 | United Kingdom . | |
| 8704852 | 8/1987 | World Int. Prop. O. | 315/5.42 |

OTHER PUBLICATIONS

Nuclear Instruments & Methods in Physics Research, vol. B50, No. ¼, Apr. 1990, pp. 444-454, R. W. Thomae, "Recent Developments in Ion Implantation Accelerators".

Patent Abstracts of Japan, vol. 12, No. 474 (E-692) (3321), Dec. 12, 1988, JP-A-63 193 499, Aug. 10, 1988.

*Primary Examiner*—Donald J. Yusko
*Assistant Examiner*—N. D. Patel
*Attorney, Agent, or Firm*—Oblon, Spivak, McClelland, Maier & Neustadt

[57] ABSTRACT

A charged particle accelerator capable of accelerating arbitrarily charged particles to an arbitrary energy level and resonating at a low frequency suitable for accelerating heavy ions, including quadruple electrodes which are supplied with high frequency power and disposed in the direction of the center axis of a cylinder-shaped container and a resonant circuit having a capacitor and an inductor for supplying a voltage to the quadruple electrodes. The capacitor is composed of a plurality of metallic plates provided along the center axis at specified intervals in the vicinity of the quadruple electrodes, and a plurality of conductive supports supporting the metallic plates which are directly connected to the container together with the supports and the container form the inductor. Since the metallic plates and the quadruple electrodes are electrically directly connected to each other, an arbitrary resonant frequency can be obtained by adjusting the intervals between the plurality of metallic plates with a position adjusting mechanism. In one embodiment, flat electrodes are protruded from opposite sides of the inner wall of the container and are disposed in parallel to the center axis and close to each other to constitute a capacitor, which makes it possible to have a resonant frequency in a low frequency range. To obtain a large Q value, the surface current resistance is lowered by covering the inner wall of the container and the surfaces of the flat plate electrodes with a superconductive material.

9 Claims, 19 Drawing Sheets

CHARGED PARTICLE ACCELERATOR

BACKGROUND OF THE INVENTION

1. Field of the Invention

The present invention relates to charged particle accelerators, in particular, to charged particle accelerators of RFQ (Radio Frequency Quadrupole) type to be utilized for the analysis of material properties or material composition, surface modification, ion implantation, etc. with the use of beams of high energy charged particles in the fields of process technology of semiconductors, medical care technology, biotechnology, etc.

2. Description of the Prior Art Recently in the manufacturing process of semiconductors, improvement has been made in high integration of circuits on a plane and in accommodating the integrated circuits in multiple layers, and the Rutherford back scattering method (RBS) is used for the analysis of atomic distribution on the IC's as the process research of the above-mentioned IC's.

On the other hand, it is desirable in the manufacture of semiconductor devices, and in particular the surface processing of semiconductor materials to impart special properties such as abrasion proof properties or corrosion resistance properties to the material surfaces. A particle induced X-ray emission method (PIXE) has been developed as a microanalysis method in ppb order, far beyond the conventional analysis precision.

As described above, ion beams (charged particles) are utilized in manufacturing processes or analysis methods. An ion beam of higher energy level is expected to be developed for the improvement of analysis precision of the above-mentioned atomic or molecular distribution in the direction of depth.

In view of the background as mentioned in the above, a linear accelerator which utilizes high (radio) frequency electric field is applied for obtaining a high energy ion beam as mentioned above. In order to improve the transmission efficiency of ions, an accelerator of a radio frequency quadrupole type (hereinafter referred to as RFQ) comprising four vane electrodes (quadrupole electrodes) and a vacuum vessel (a cylinder-shaped container), which works as a resonant cavity having a high Q value, a reciprocal number of the energy loss in a resonant circuit, has been developed.

In FIG. 15, a schematic construction of a conventional RFQ is shown and in FIG. 16, the construction of electrodes is shown.

The electrodes 1, 2, 3 and 4 constituting quadrupole electrodes are disposed in the direction of the center axis of the cylinder-shaped container 5 and the respective surfaces of electrodes 1, 2, 3 and 4 facing each other have uneven corrugated forms. FIGS. 17 (*a*) and (*b*) show the sectional views of their relative positions.

In FIG. 17(*a*), the corrugated forms of facing electrodes are formed in phase and in FIG. 17(*b*), the corrugated forms of facing electrodes are formed in opposite phase. When a high frequency voltage of specified frequency is applied to the cavity formed inside the container 5 with a loop type coupler 11 as shown in FIG. 18, a high frequency current of the resonant frequency having a mode $TE_{210}$ is excited as shown in the figure. In this case, the same electric potential is generated in the facing electrodes and an opposite electric potential is generated in the adjacent electrodes. Because of this, in the vicinity of the axis where four electrodes 1, 2, 3 and 4 are facing each other, basically a quadrupole electric field is generated (not shown in the figure).

In FIG. 18, reference numeral 9 designates the electric field and reference numeral 10 designates the magnetic field.

The explanation about the influence exerted by the above-mentioned corrugated structure in the axis direction of the four electrodes 1, 2, 3 and 4 in the quadrupole electric field as described in the above will be given based on FIGS. 19(*a*) and 19(*b*). FIG. 19(*a*) corresponds to a vertical cross sectional view and FIG. 19(*b*) corresponds to a horizontal cross sectional view.

For example, in the above-mentioned $TE_{210}$ mode when electrodes 1 and 3 are positive, electrodes 2 and 4 are negative, and when the former ones are negative, the latter ones are positive. In addition to such a condition as mentioned in the above, corrugated forms of electrodes 1, 2, 3 and 4 are formed being shifted 180 degrees concerning the horizontal and vertical directions; therefore, for example, when the electrodes 1 and 3 are positive and the electrodes 2 and 4 are negative an electric field in the direction of the center axis is generated on the center axis. The arrows 6, 7 and 8 show the directions of electric fields.

When the polarities of the voltages to be applied to the electrodes 1, 2, 3 and 4 are reversed, the directions of electric fields are also reversed.

For example, when the ions come into the electrode construction along the center axis from the left side in the figure and have a velocity and a phase to be constantly given accelerating electric fields toward the left and the right, the ions are accelerated each time they pass the corrugated formed portions of the electrodes 1, 2, 3 and 4, and their energy is monotonously increased. The ions which at first come into the electrode construction with the phase to be given deceleration are gradually bunched up in the following particles when they pass the next accelerating electric field and after that they are monotonously accelerated.

As described in the above in the case of an RFQ, ions which come in in any phase are finally bunched up and are effectively accelerated.

A strong focusing force is generated in the vertical and horizontal directions by a strong high frequency quadrupole electric field which exists on a plane being perpendicular to the axis, so that ions are accelerated at very high transmissivity.

Actually, the transmission efficiency being close to 100% can not be obtained until electrodes of the optimum design are obtained by changing the period of corrugated forms and the intervals between electrodes little by little in consideration of the increase in ion velocity or of the state of bunching of ions.

In the case of an RFQ as described in the above, the accelerating tube forms a high frequency resonant cavity together with the electrodes 1, 2, 3 and 4, and the resonant frequency ($TE_{210}$ mode) is decided by its geometrical dimensions so that it is impossible to largely vary the resonant frequency. The problems in an RFQ which are caused by this structure will be explained in the following.

Generally, in the case of an accelerator utilizing radio frequency waves, ions are accelerated in a state where the travel motion of ions is synchronized with the variation of an accelerating electric field; therefore when the velocity of incident ions is decided for a given kind of ions (e/m), there exists one synchronization condition between an accelerating frequency and the period of the corrugated portions of electrodes; thereby the final accelerating energy obtained with an accelerating tube of a certain length takes an inherent value for a certain kind of ions. In the practical range of tube length and input power, the period of corrugated portions of electrodes is selected to be in the range of several mm to several cm. The above-mentioned RFQ for protons ($H^+$) is thus set, and has the dimensions of 1.5 m in length and 0.5 m in diameter, and has the resonant frequency of about 100 MHz. If ions, for example, a chemical element $As^+$, a dopant element for semiconductors, is accelerated in synchronization with the use of an RFQ which can accelerate $H^+$up to lMev, the final energy reaches 75 Mev (mass ratio), as an ion energy is expressed by $eV=\frac{1}{2}mv^2$ (e: electric charge of an ion, V: accelerating voltage for an ion, m: ion mass and v: ion velocity); it is impossible, of course, to input electric power so as to generate such a high gradient accelerating electric field.

From a different viewpoint, when it is considered to make a 1 Mev accelerator to be used exclusively for $As^+$with an RFQ, there are two ways: one is to make the total length 1/75 keeping the frequency as it is and the other is to lower the resonant frequency to 1/75 keeping the length as it is. In the case of the former, the period of the corrugated portions of electrodes must be reduced together with the shortening of the total length which causes a problem in working. and also the intervals between . electrodes (bore diameter) must be reduced to obtain an effective accelerating electric field, which is not suitable for practical use in making the acceptance area for incident ions small. In the case of the latter, to obtain such a low frequency with the same construction as that shown in FIG. 18, the diameter of an accelerating tube must be made 75 times large, which is not practical from a manufacturing standpoint.

In conclusion it is geometrically impossible to make an apparatus as an accelerator for heavy ions for the purpose of industrial utilization with the RFQ of the original type.

In the case of an apparatus for the purpose of obtaining an arbitrary energy level for an arbitrary kind of ions which can be utilized in industry, the accelerating frequency must be variable. In the case of an RFQ, in which the container 5 itself functions as a resonant cavity, the resonant frequency is definitely decided by the geometric form of the container 5, and the setting cannot be arbitrarily changed.

In consideration of such a situation, an accelerator having a function as shown in the following is proposed: an RFQ is provided with an external resonant circuit composed of a variable capacitor and an inductor to be able to accelerate an arbitrary kind of ions to have arbitrary energy level with the supply of high frequency voltage to the electrodes inside the container.

An example of such an accelerator is shown in FIG. 20. The accelerator is indicated in the preliminary manuscript collection for lectures in 36th allied lecture meeting of Applied Physical Society and the related learned societies (second separate volume p 554, Spring, 1989).

As shown in the figure, an external resonant circuit 13 which is provided outside quadrupole electrodes 12 is formed with a cylindrical copper one-turn coil 14 and two variable vacuum capacitors 15 in parallel. High frequency power is led to a coupling capacitor 17 through a coaxial connector 16, and is magnetically coupled to the one-turn coil 14. Both ends of the vacuum variable capacitor 15 are connected to the quadrupole electrodes 12 to contribute to the acceleration of ions.

Besides the above-mentioned apparatus, there is an apparatus having a practical size and able to generate a low frequency voltage for accelerating heavy ions. For example, in the case of a charged particle accelerator shown in FIGS. 21(*a*) and 21(*b*), the accelerating tube is excited with a voltage in a $TM_{010}$ mode, and from respective end plates 81 and 82 located at both ends of the cavity 80 two beams 83 and 84 are protruded toward the opposing end plate 81 or 82, and these beams are made to be close to each other in the circumference of the center axis to obtain a static capacity C, and respective accelerating electrodes 85 constituting quadrupole electrodes are, as shown in FIG. 20(*b*), electrically connected to respective beams, 83, 83, 84 and 84, and are fixedly disposed toward the center axis. In the $TM_{010}$ mode, lines of magnetic flux 87 are distributed as if they go around the center axis, so that the inductance L can be made large by lengthening the accelerating tube, which makes it possible to lower the resonant frequency.

In the case of an accelerator having an external resonant circuit 13 like the first example of a conventional apparatus shown in FIG. 20, a cable for supplying power to the quadrupole electrodes 12 from the external resonant circuit 13 has stray inductance and stray capacitance which cannot be ignored and also the Q value is degraded by the loss in the cable.

In order to lower a resonant frequency it is necessary to enlarge the diameter of a coil or to increase the capacitance of a capacitor in a resonant circuit; in any way, the geometrical form/size differs much from thin and long RFQ electrodes, and cable wiring for a relatively long distance is needed. When wiring is hung in the air, it is exposed to external disturbances and the apparatus becomes unstable; when wiring is cabled with a coaxial cable or the like, large stray capacitance cannot be avoided.

In order to make the inductance component of an accelerating cavity (container) large, it can be considered to provide an additional electrode of a coiled form inside the cavity or to deform the supporting members for supporting the tip portions of the quadrupole electrodes to coiled forms. It is true that owing to such contrivance a comparatively low resonant frequency can be obtained for the diameter, of its accelerating cavity; in this case however, the path of a surface current in the coil portion becomes long, which decreases the value of Q due to the increase in resistance.

In the case of a second example of a conventional apparatus as shown in FIGS. 21 (*a*) and 21(*b*), there are problems as discussed below.

1. A surface current 86 on the surface of the cavity flows to the accelerating electrodes 85 through end plates 81 and 82, but it is difficult to make the electrical connection between the end plates 81 and 82, and the cylindrical cavity complete from the point of views of assembling and maintenance, and the incompleteness often causes lowering of Q or generation of heat at a bad contact point.

2. Each pair of beams among four beams, 83, 83, 84 and 84, are supported with an end plate 81 or 82 in the state of cantilevers, so that the longer is the accelerating tube 80, the harder it becomes to fix the electrodes 85, to be fixed to the beams 83 and 84, with precise relative positions.

3. The surface current 86 induced with a resonant mode flows through the accelerating electrodes 85, and the beams 83 and 84, so that it generates a voltage gradient in the direction of the center axis, which makes it impossible to obtain an ideal RFQ electric field.

SUMMARY OF THE INVENTION

The present invention is invented in consideration of the problems in conventional apparatuses as described in the above, and an object of the present invention is to provide a charged particle accelerator having a high Q value which is able to accelerate an arbitrary kind of charged particles to an arbitrary energy level and in which a static capacitor and an inductor are ensured which make the resonance possible in a low frequency range without causing lowering of the Q value by contriving the constitution of a resonant circuit, and also the connecting structure between the resonant circuit and quadrupole electrodes.

For achieving the above-mentioned object, according to a first embodiment of the present invention, there is provided a charged particle accelerator being able to accelerate an arbitrary kind of charged particles to an arbitrary energy level in passing the charged particles through quadrupole electrodes disposed in the direction of a center axis inside a cylinder-shaped container by supplying a specified potential to the quadrupole electrodes from a resonant circuit composed of a capacitor and an inductor, wherein the capacitor comprises a plurality of conductive metallic plates disposed along the center axis with specified intervals in the vicinity of the quadrupole electrodes inside the container, the inductor comprises the container and a plurality of conductive metallic supports for supporting the metallic plates and being directly connected to the container, and the metallic plates are electrically directly connected to the quadrupole electrodes.

According to a second embodiment of the present invention, there is provided a charged particle accelerator being able to accelerate an arbitrary kind of charged particles to an arbitrary energy level in passing the charged particles through quadrupole electrodes disposed in the direction of a center axis inside a cylinder-shaped container by supplying a specified potential to the quadrupole electrodes from a resonant circuit composed of a capacitor and an inductor, wherein the capacitor comprises a plurality of conductive metallic plates disposed along the center axis with specified intervals in the vicinity of the quadrupole electrodes inside the container, the inductor comprises the container and a plurality of conductive metallic supports for supporting the metallic plates and being directly connected to the container, the metallic plates are electrically directly connected to the quadrupole electrodes, and a position adjusting mechanism making the metallic plates movable in the center axis direction of the container is provided.

Furthermore, according to a third embodiment of the present invention, there is provided a charged particle accelerator being able to accelerate an arbitrary kind of charged particles to an arbitrary energy level in passing the charged particles through quadrupole electrodes disposed in the direction of a center axis inside a cylinder-shaped container by supplying a specified potential to the quadrupole electrodes from a resonant circuit composed of a capacitor and an inductor, wherein the capacitor comprises flat plate electrodes which are protruded from opposing both side surfaces of the inner wall of the container toward respective opposing sides and are disposed in parallel to the center axis in such a manner as for making side surfaces of the flat plate electrodes close to each other at specified intervals, the inductor comprises the flat plate electrodes and the container connected to the flat electrodes, and the flat plate electrodes are electrically directly connected to the quadrupole electrodes.

In the charged particle accelerator according to the above-mentioned third embodiment it is made possible to introduce superconductive technology by covering the inner wall of the container and the flat plate electrodes with a superconductive material and by providing the container with a cooling means.

According to a fourth embodiment which is obtained by improving the third embodiment of the present invention, there is provided a gas laser apparatus comprising: a resonant circuit having a capacitor and an inductor being accommodated inside a cylinder-shaped container; a pipe made of a low dielectric constant such as melted quartz disposed on the center axis of the resonant circuit to be introduced with an arbitrary gas; reflecting mirrors provided on both ends of the pipe for constituting an optical resonator of a Fabry-Perot type; and a high frequency power supply for supplying to the resonant circuit for generating plasma by high frequency discharge inside the pipe and for obtaining laser oscillation in exciting the introduced arbitrary gas.

Further, according to a fifth embodiment which is obtained by improving the third embodiment of the present invention, there is provided a plasma CVD apparatus comprising: a resonant circuit having a capacitor and an inductor being accommodated inside a cylindrical container; a pipe made of a low dielectric constant such as melted quartz disposed on the center axis of the resonant circuit to be introduced with an arbitrary gas to be excited with plasma generated inside the pipe by high frequency discharge caused by high frequency power applied to the resonant circuit.

In the charged particle accelerator according to the first and the second embodiments of the present invention, the capacity of the inductor and the capacitor can be changed by properly changing the intervals of a plurality of metallic plates, which makes it possible to accelerate an arbitrary kind of charged particles to an arbitrary energy level.

In this case, when the metallic plates are adjusted with a position adjusting mechanism, the interval dimensions can be changed in a simpler way.

In the above-mentioned structure, the inductor and the capacitor which compose the resonant circuit are constituted as if they are directly connected to the quadrupole electrodes, so that they do not incur the lowering of Q value.

In a charged particle accelerator according to the third embodiment of the present invention, a comparatively large static capacitance can be obtained by disposing the flat plate electrodes closely to each other in parallel to the center axis which are protruded from the opposing side surfaces of the inner wall of the container toward the respective opposite sides, and since the pass region of lines of magnetic flux can be secured wide enough by disposing the flat plate electrodes parallel to the center axis, it is possible to make a resonant frequency be in a low frequency region in constituting an inductor with the flat plate electrodes and the container. Owing to this, an accelerator of a practical size can be realized which can accelerate heavy ions.

In the constitution as shown in the third embodiment, a pure resistance value for a surface current can be lowered by covering the inner wall of a container and flat plate electrodes with a superconductive material; thereby a value of Q can be made large and an accelerator of very high power efficiency can be obtained.

Further in the fourth embodiment according to the present invention, when an arbitrary gas to be a laser medium is introduced into a pipe which is disposed on the center axis of the resonant cavity and a high frequency power is supplied to the resonant cavity, the arbitrary gas is excited and generates a laser light; thereby an optical resonance is generated with reflecting mirrors provided on both ends of the pipe and laser oscillation is performed.

The charged particle accelerator according to the present invention is constituted as described above, so that it is possible to have a constitution in which the resonant circuit and the quadrupole electrodes are directly connected. Thereby, an arbitrary kind of charged particles can be accelerated to an arbitrary energy level without lowering the value of Q.

High frequency acceleration of heavy ions can be efficiently performed by constituting a resonator composed of a capacitor and an inductor which enable resonant oscillation in a low frequency range and a high Q accelerator, thereby it is possible to offer a charged particle accelerator which is suitable for practical use as an industrial apparatus to be used for semiconductor processes, or for analysis of material properties or compositions.

Further, a resonant circuit which constitutes the charged particle accelerator can be a high Q resonant cavity, so that it can be applied to a gas laser apparatus of good power efficiency which generates laser light and a plasma CVD apparatus of high power supply, by efficiently exciting a medium gas introduced into a pipe disposed on the center axis of the cavity.

A more complete appreciation of the invention and many of the attendant advantages thereof will be readily obtained as the same becomes better understood by reference to the following detailed description when considered in connection with the accompanying drawings, wherein:

EXPLANATION OF SYMBOLS

18, 36 or 38—Charged particle accelerator
19—Container
21, 22, 23 or 24—Electrode
26*a* or 26*b*—Metallic plate
30 or 31—Support
39—Flange
40—Block
41*a* or 41*b*—Female screw
43*a* or 43*b*—Male screw member
45—Shaft
46—Position adjusting mechanism
47—Quadrupole electrodes
52—Superconductive material
53—Cooling pipe (Cooling means)
55—Quartz pipe (pipe)
56 or 57—Concave mirror (mirror)
61 or 62—Flat plate electrode
65—Intermediate electrode

DESCRIPTION OF PREFERRED EMBODIMENTS

The embodiments according to the present invention will be explained referring to the attached drawings for the better understanding of the present invention. The following embodiments are examples of embodied present invention; they are not, however, intended as definitions of the limits of the technical scope of the present invention.

Figure 1:
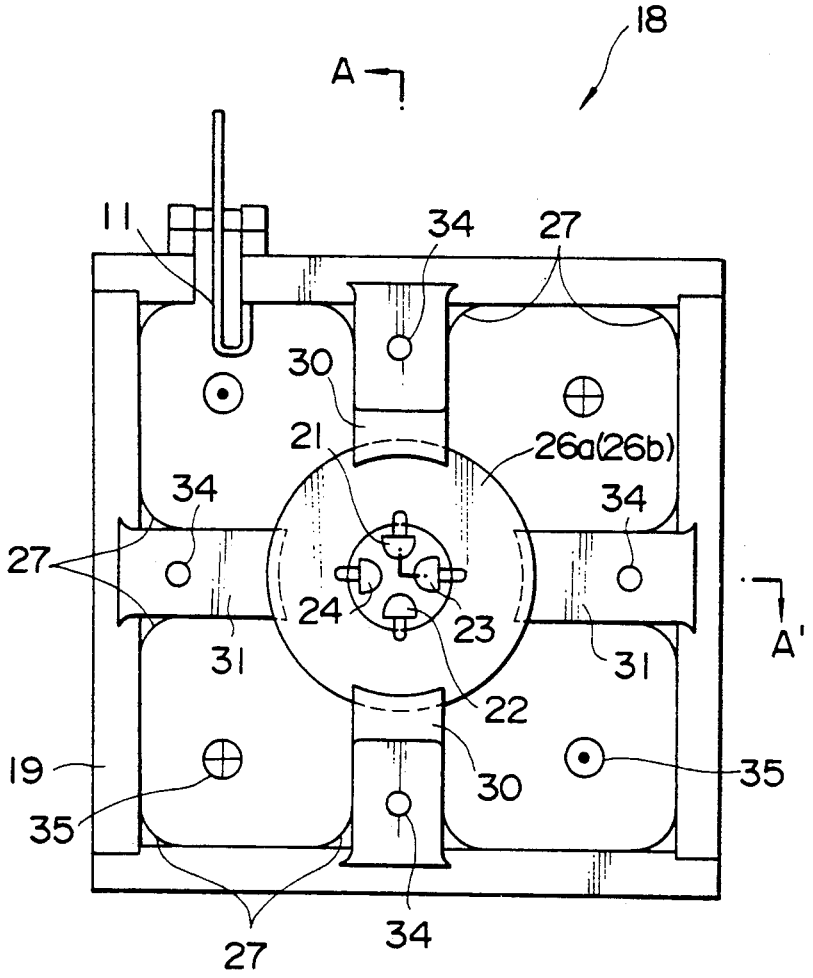
FIG. 1 is a front view of a charged particle accelerator in an embodiment according to the present invention.
Figure 2:
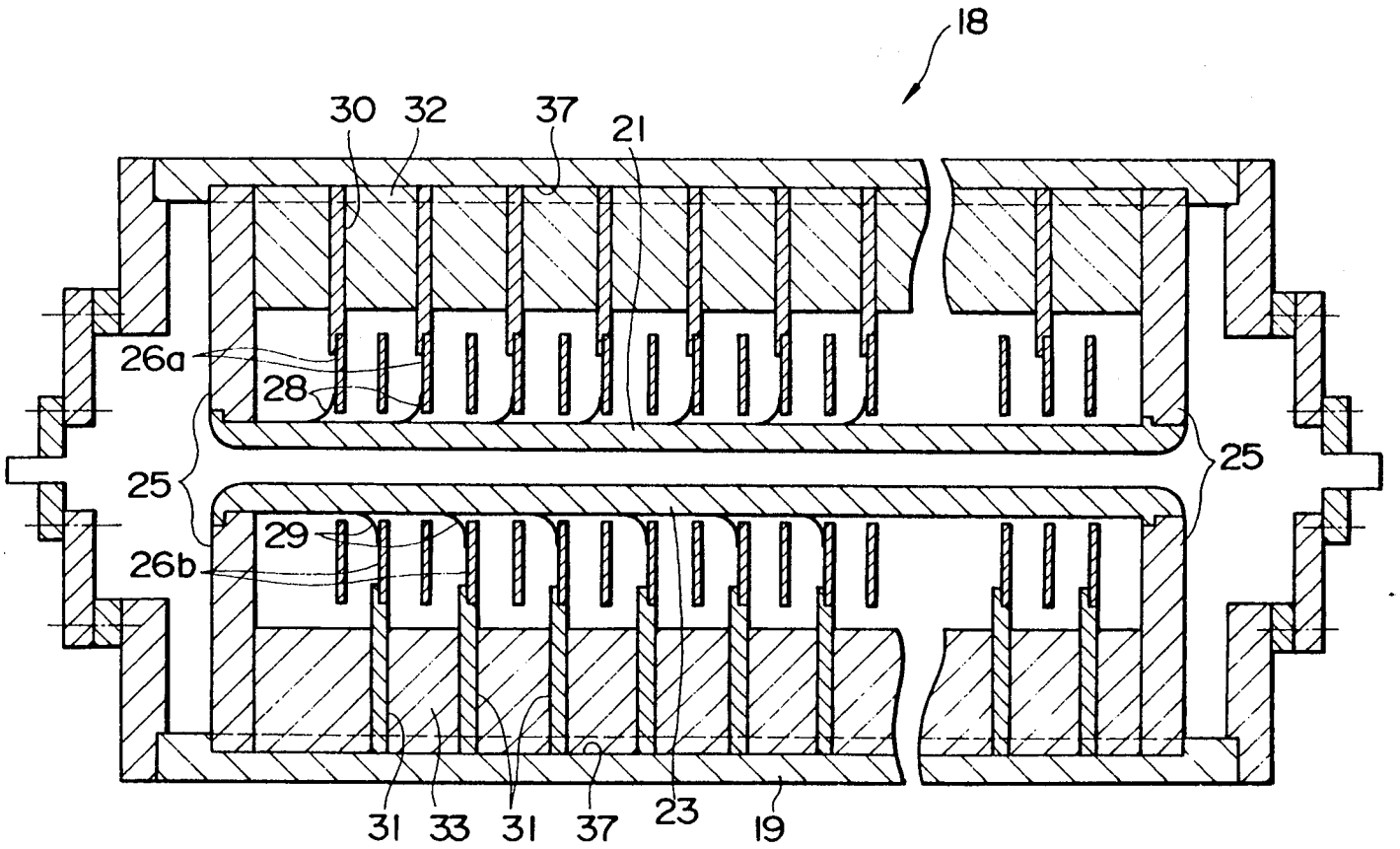
FIG. 2 is a sectional view taken on line A—A' in FIG. 1.
Figure 3:
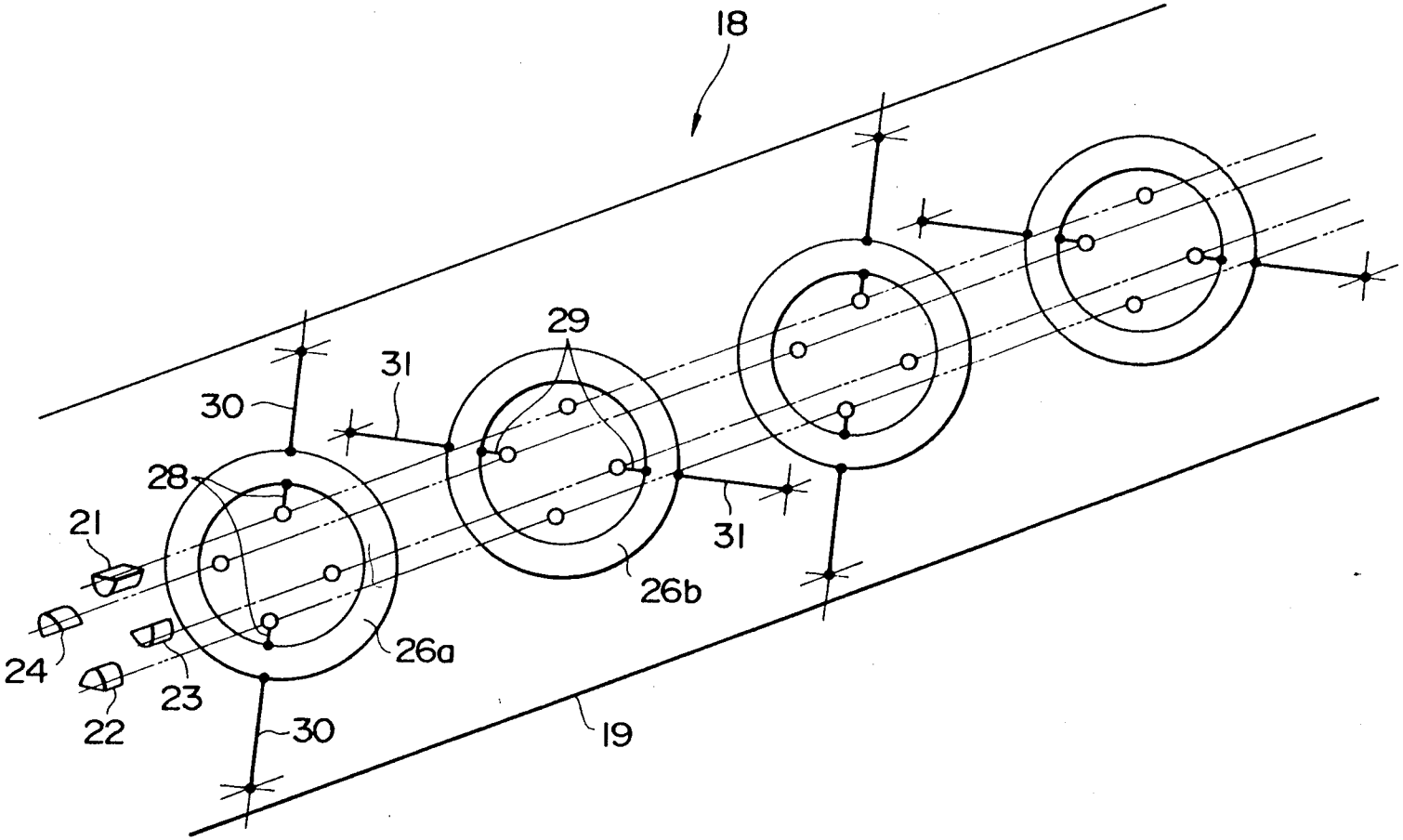
FIG. 3 is a schematic representation showing the outline of the electric connection diagram of the quadrupole electrodes in FIG. 2.
Figure 4:
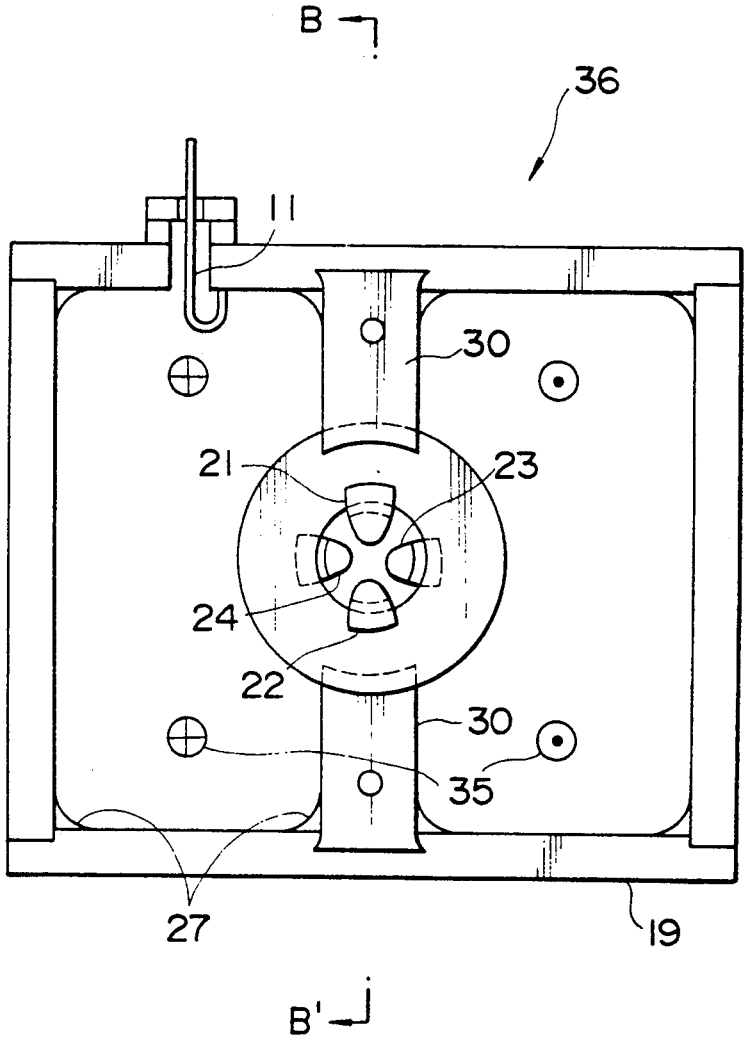
FIG. 4 is a front view of a charged particle accelerator according to another embodiment of the present invention.
Figure 5:
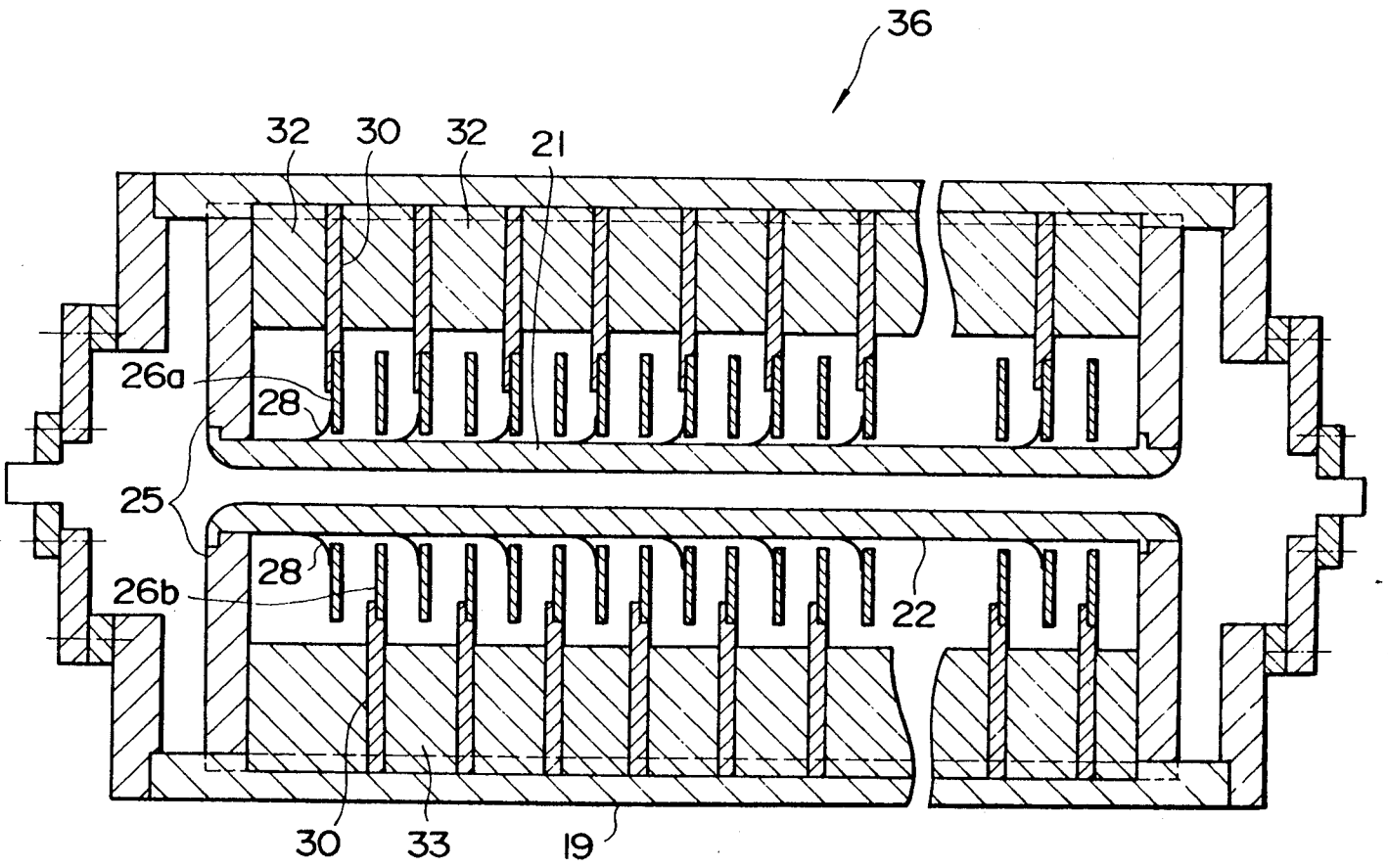
FIG. 5 is a sectional view taken on line B—B' in FIG. 4.
Figure 6:
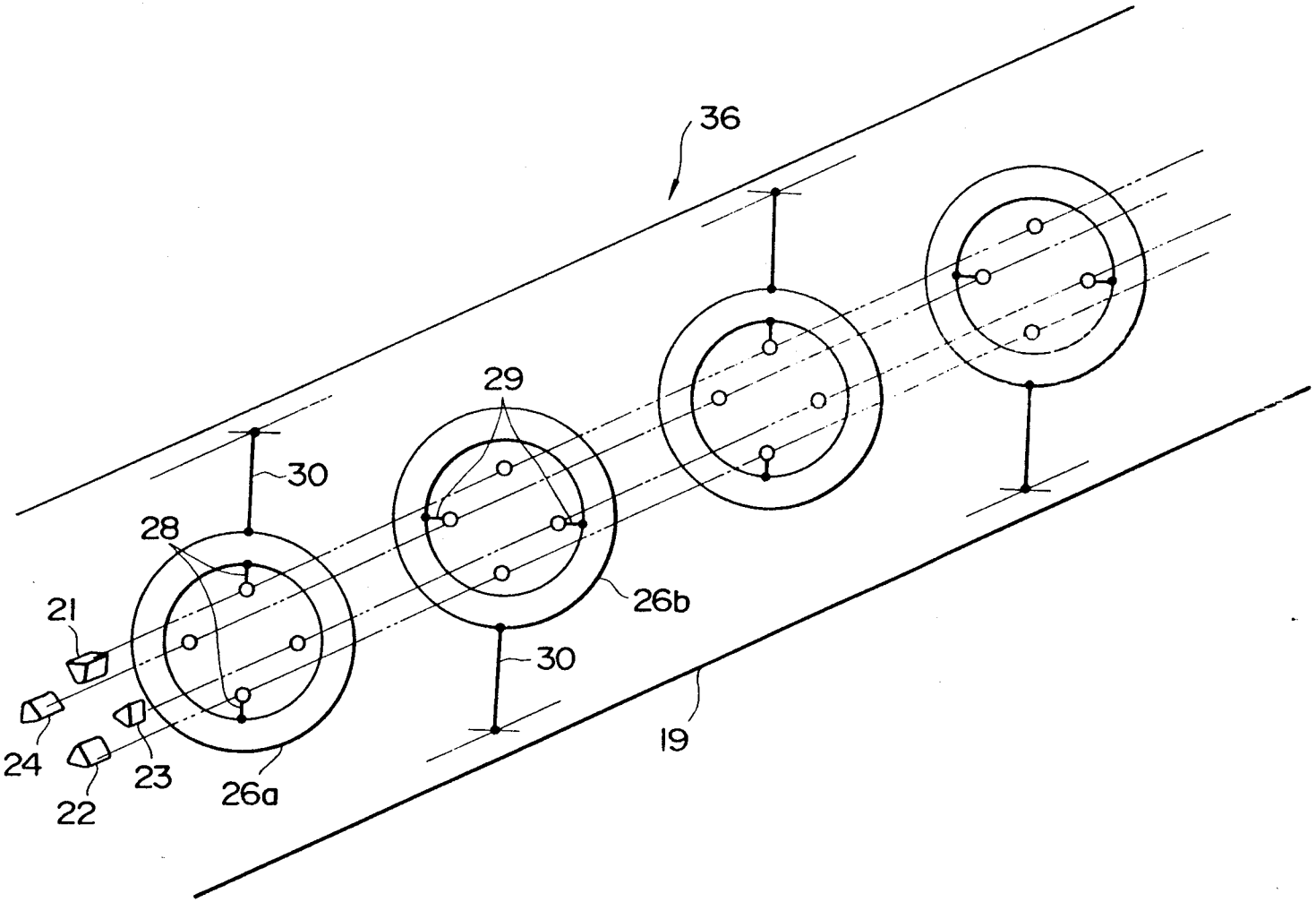
FIG. 6 is a schematic representation showing the outline of the electric connection diagram of the quadrupole electrodes in FIG. 5.
Figure 7A:
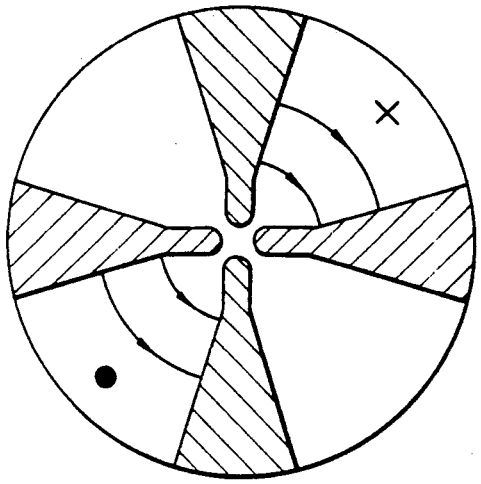
FIG. 7(*a*) and 7(*b*) shows an excited state at a resonant frequency in a $TE_{110}$ mode: where FIG. 7(*a*) is an illustrative representation in a state where a cavity is provided with quadrupole electrodes and FIG. 7(*b*) is an illustrative representation in a state where only a cavity is provided.
Figure 7B:
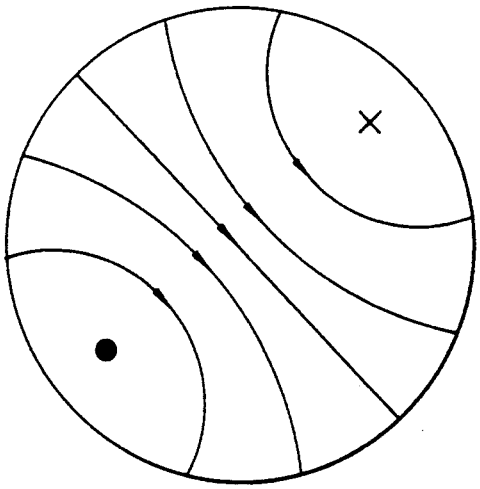
Figure 8:
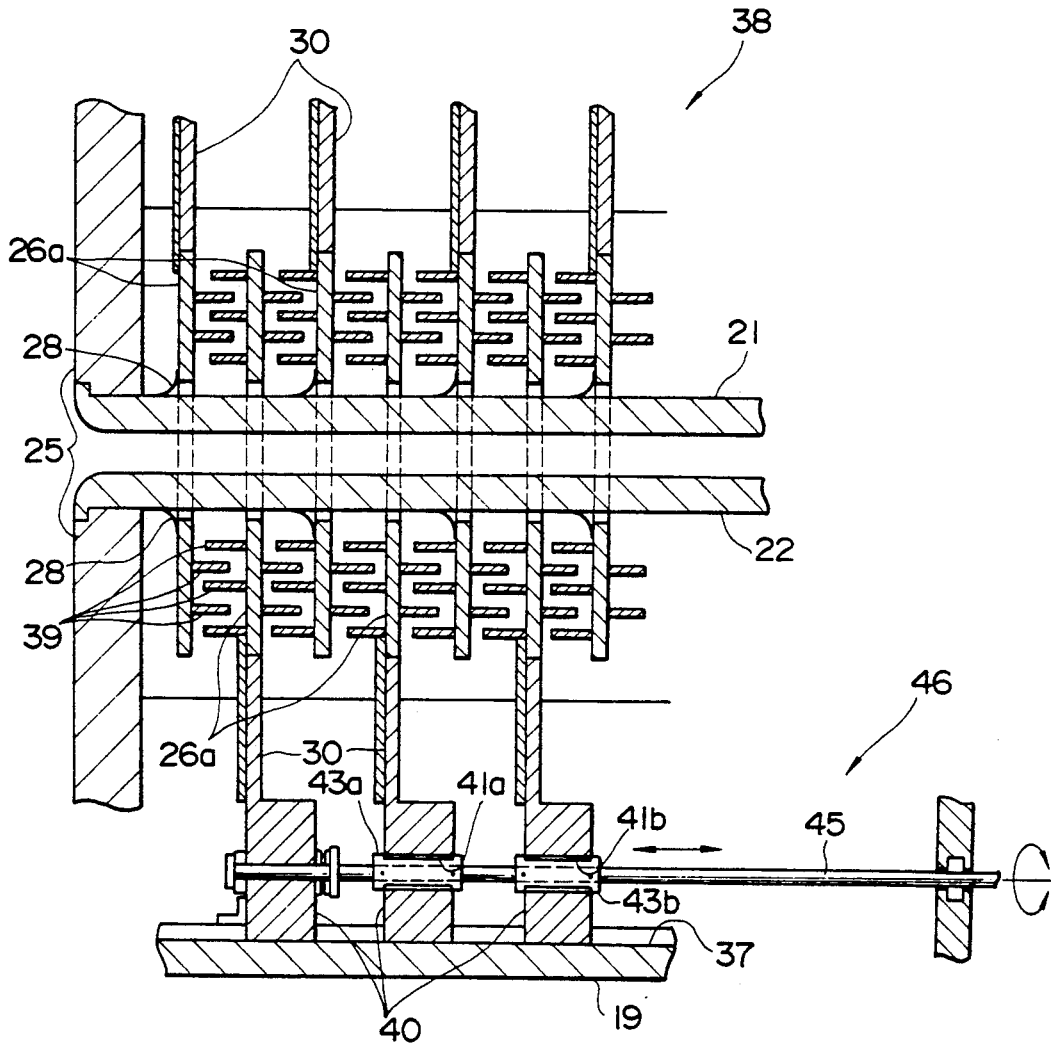
FIG. 8 is a side sectional view showing the constitution of a principal portion of a further embodiment of the present invention.

FIG. 1 and FIG. 2 show the constitution of a charged particle accelerator according to a first embodiment of the present invention, and FIG. 1 is a front view and FIG. 2 is a sectional view taken on line A—A' in FIG. 1; FIG. 3 is a schematic diagram showing the outline of the electric connection diagram of a charged particle accelerator; FIG. 4 is a front view showing the constitution of a charged particle accelerator according to a second embodiment of the present invention; FIG. 5 is a sectional view taken on line B—B' in FIG. 4; FIG. 6 is a schematic representation showing the outline of the electric connection diagram of a charged particle accelerator according to a second embodiment of the present invention; FIGS. 7(*a*) and 7(*b*) show an excited state at a resonant frequency in a $TE_{110}$ mode in an accelerating cavity: where FIG. 7(*a*) is an illustrative representation in a state where quadrupole electrodes are provided to a cavity, and FIG. 7(*b*) is an illustrative representation in a state where only a cavity is provided; FIG. 8 is a side sectional view showing the constitution of a principal portion of a charged particle accelerator according to a third embodiment of the present invention.

In a charged particle accelerator 18 according to the first embodiment, electrodes 21, 22, 23 and 24 which are disposed in a container 19 (accelerating cavity), for example of a front section of a rectangle, in the direction of its center axis are shown in FIG. 1, FIG. 2 and FIG. 3; quadrupole electrodes are composed of these electrodes. The facing surfaces of the electrodes 21 to 24 are formed in corrugated forms similar to those of a conventional RFQ.

At the corner portions of the container 19, RF contact electrodes 27 are fixed in consideration of lowering the electric resistance.

Both end portions in the longitudinal direction of the above-mentioned electrodes 21 to 24 are fixed to the inner wall of the container 19 through supports 25 made of an insulating material.

In the vicinity of the electrodes 21 to 24 in the longitudinal direction surrounding them, metallic plates 26*a* and 26*b* made of, for example, ring-shaped copper disks are alternately disposed at specified equal intervals. In this case, the subscripts (a) and (b) are attached for the purpose of explanation and these metallic plates 26*a* and 26*b* are constitutionally identical parts.

The electrodes 21 and 22 are electrically directly connected to the metallic plates 26*a*, 26*a* through RF contact electrodes 28, and the electrodes 23 and 24 are electrically directly connected to the metallic plates 26*b*, 26*b* through RF contact electrodes 29.

Further, the metallic plates 26*a* are supported by copper supports 30, 30, in the vertical direction and are electrically directly connected to the container 19. The metallic plates 26*b* are supported by copper supports 31, 31, in the horizontal direction and are electrically directly connected to the container 19.

The supports 30 and 31 are disposed to be movable toward the center axis along dovetail grooves worked on the inner wall of the container 19, and in the gaps between the supports 30, 30, and 31, 31, spacers 32, 33, are inserted having the dimensions in width to be able to maintain the intervals between the metallic plates 26*a* and 26*b* at a specified equal dimension. The supports 30 and the spacers 32, and the supports 31 and the spacers 33 are fastened commonly by bolts 34 respectively.

Figure 18:
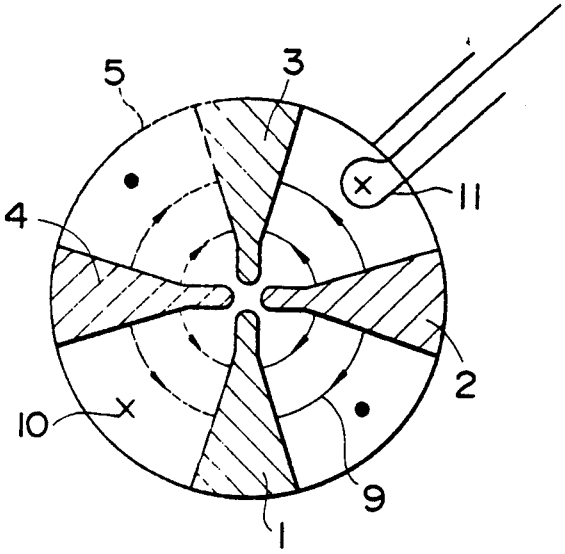
FIG. 18 (PRIOR ART)
FIG. 18 is an illustrative representation showing the excitation of a resonant frequency oscillation in a $TE_{210}$ mode in an accelerating cavity provided with quadrupole electrodes.
Figure 19A:
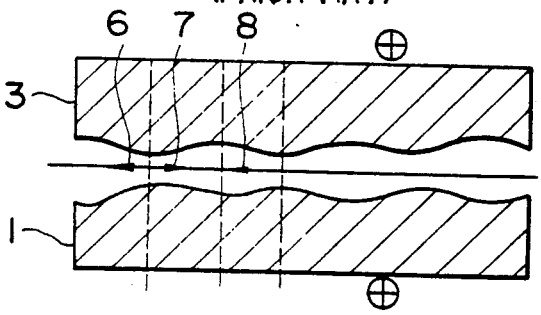
FIG. 19(a) (PRIOR ART)
FIG. 19(*a*) and 19(*b*) illustrative representations of the influence of corrugated forms of electrodes: where FIG. (*a*) is a vertical sectional view, and FIG. 19 (*b*) is a horizontal sectional view.
Figure 19B:
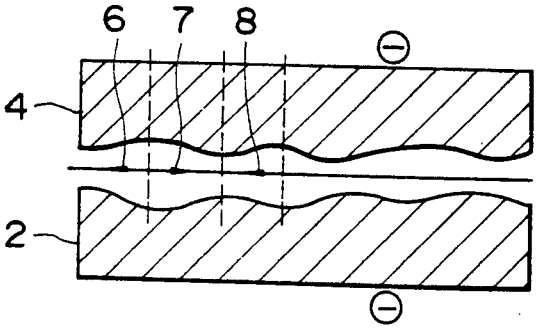
FIG. 19(b) (PRIOR ART)
Figure 20:
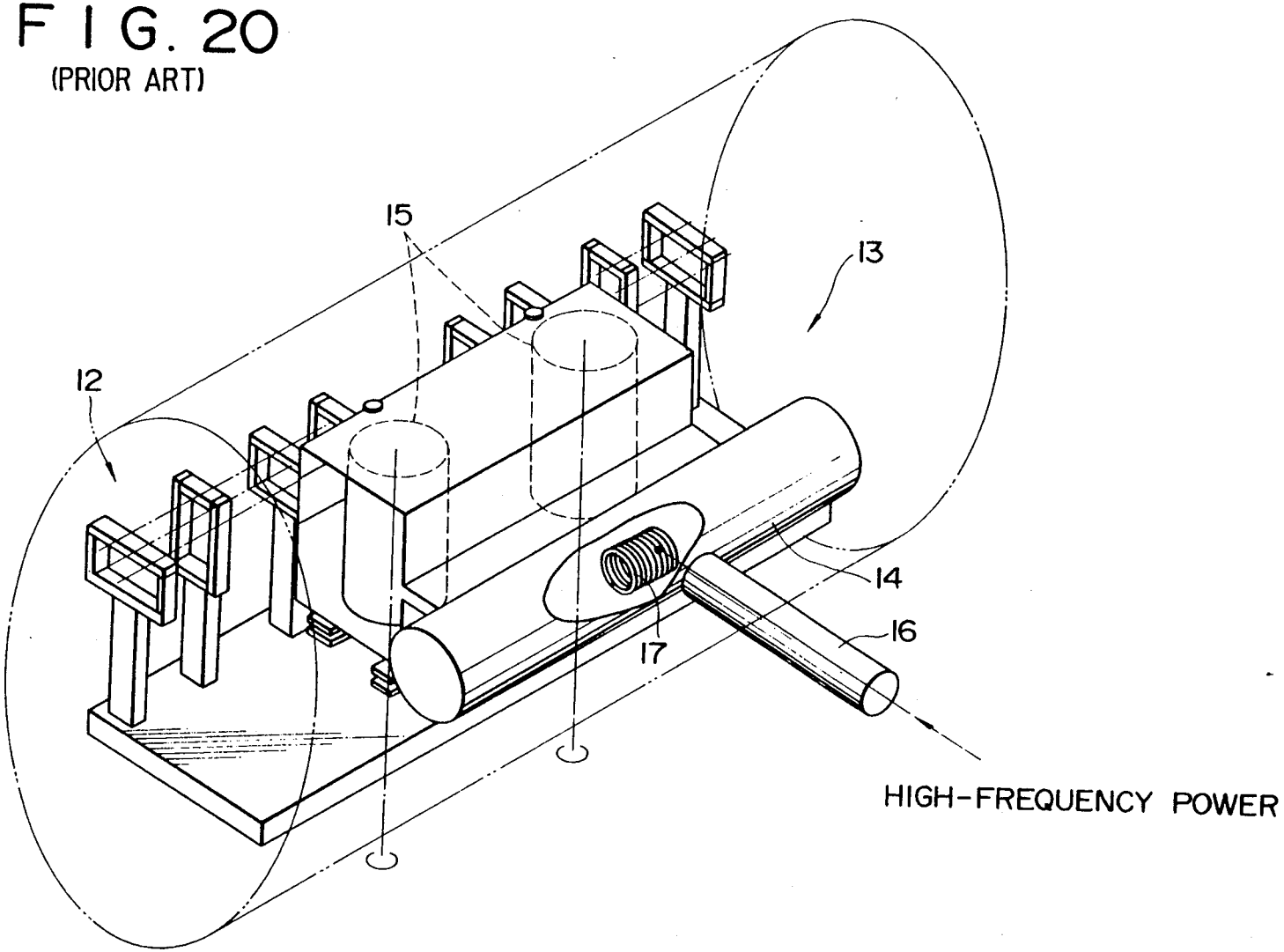
FIG. 20 (PRIOR ART)
FIG. 20 is a perspective view showing the schematic constitution of a conventional ion accelerator of a variable resonant frequency type.
Figure 21A:
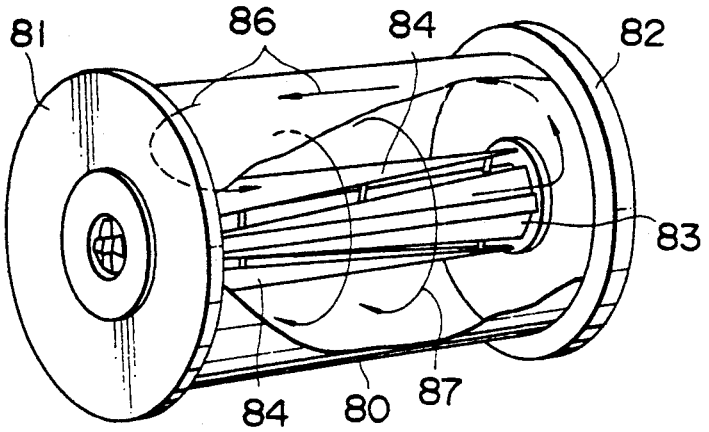
FIG. 21(a) (PRIOR ART)
FIG. 21(*a*) and 29(*b*) show an example of a conventional accelerating cavity: where FIG. 21(*a*) is a perspective view, and FIG. 21(*b*) is a sectional view.
Figure 21B:
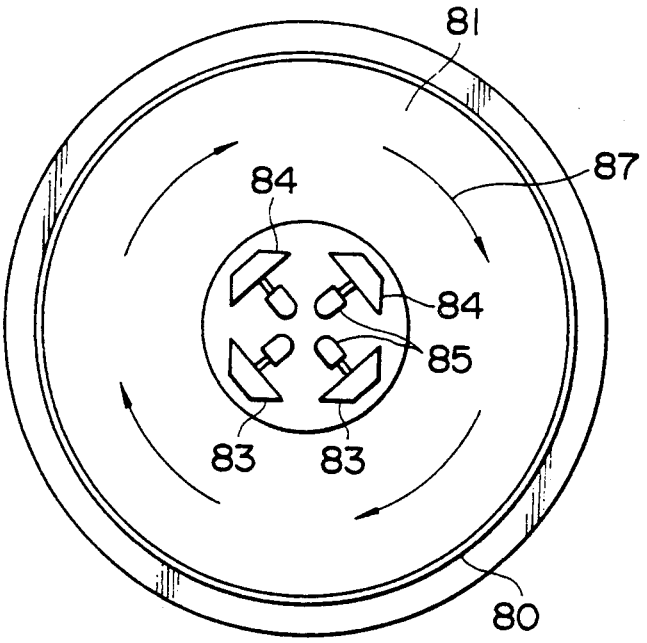
FIG. 21(b) (PRIOR ART)

A capacitor is composed of a plurality of metallic plates 26*a* and 26*b* and a one-turn coil of an open loop is composed of the supports 30, the container 19 and the supports 31; thereby a high frequency current of the resonant frequency, for example, in a $TE_{210}$ mode as shown with flux 35 in FIG. 18 can be excited. The capacities of the capacitor and the inductor can be changed by changing the dimension in width of the spacers 32 and 33 to a proper value, which enables the apparatus to accelerate an arbitrary kind of ion beams to an arbitrary energy level.

The resonant frequency as described in the above is lower in comparison with that in the case where only a cavity is provided, but the value of Q is not degraded because the resonant circuit constituted as described above and the quadrupole electrodes are almost directly connected and the path length of the surface current is vertically unchanged.

In the case of the resonant circuit so constituted as mentioned above, the static capacitance between the metallic plates 26*a* and 26*b* contributes mainly, so that a high frequency current almost does not flow, except a beam loading current, between the metallic plates 26*a* and 26*b*, and electrodes 21 to 24; therefore simple contact between them is good enough for the connections between the electrodes 21 to 24, and the metallic plates 26*a* and 26*b*.

In such a connection structure, out of 2 pairs of electrodes 21, 22, 23 and 24, 1 pair of them in the vertical or horizontal direction are kept at the same potential through the metallic plates 26*a* and 26*b*, so that a resonant frequency which stabilizes the operation of a RFQ of this kind, for example, a resonant frequency in a $TE_{110}$ mode having an electric field distribution as shown in FIG. 7(*b*) is suppressed.

Next, a charged particle accelerator 36 according to the second embodiment of the present invention will be explained based on FIG. 4, FIG. 5 and FIG. 6. In the charged particle accelerator 36, for the elements being common to those of the charged particle accelerator 18 according to the first embodiment the same symbols will be used and the detailed explanations for them will be omitted.

In the charged particle accelerator 36 according to the second embodiment, metallic plates 26*a* and 26*b* are respectively supported in the vertical direction with supports 30 and 30 protruded alternately from opposite directions in the state of cantilevers one corresponding to one, as shown in the figure. From the metallic plates 26*a* and 26*b* a potential is applied to the electrodes 21 and 22 through the RF contact electrodes 28 in the vertical direction, and from the metallic plates 26*b* a potential is applied to the electrodes 23 and 24 through the RF contact electrodes 29 (refer to FIG. 6) in the horizontal direction.

As a result, an RFQ utilizing a $TE_{110}$ mode (refer to FIG. 7) having a magnetic flux distribution as shown by magnetic flux 35 in FIG. 4 can be realized.

A resonant frequency in this mode has lower value than that in a $TE_{210}$ mode which is used normally;

therefore the above-mentioned RFQ is suited to realize the acceleration of heavy ions.

Figure 22A:
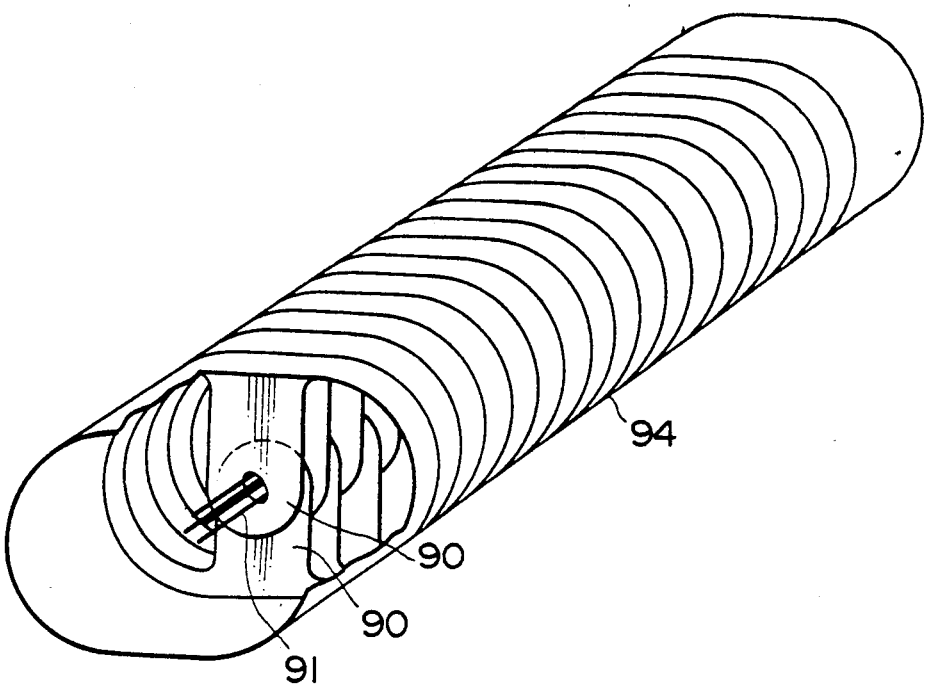
FIG. 22(*a*) and 22(*b*) show an example of a realistic structure of an accelerating cavity according to the present invention: where FIG. 22(*a*) is a perspective view, and FIG. 22(*b*) is a sectional view.
Figure 22B:
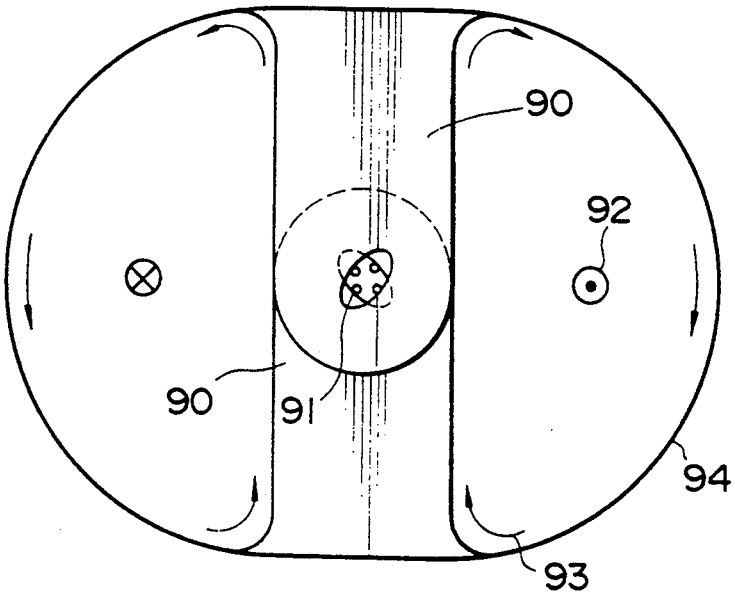

A realistic apparatus is shown in FIGS. 22(*a*) and 22(b). Flat plate electrodes 90 perpendicular to the center axis are protruded from opposing surfaces constituting the cavity, and a comparatively large static capacitance C is obtained by making them have a layer built structure in the circumference of the center axis, which makes it possible to arrange the apparatus to have a low resonant frequency to be excited with a low frequency voltage. In this case, the resonant mode is a $TE_{110}$ mode, and as shown in FIG. 22(b) the lines of magnetic flux 92 are generated parallel to the center axis in the space surrounded with flat plate electrodes 90 and the cavity wall 94, and the surface current 93 flows from the flat plate electrodes on a side to the flat plate electrodes on the opposite side through the cavity wall 94 as if the current surrounds the lines of magnetic flux in the direction perpendicular to the center axis as shown in FIG. 22(*b*). An accelerating electrode 91 comprises 2 sets of a facing pair of electrodes disposed in parallel to the center axis in opening port portions on the flat plate electrodes 90 in the position of the center axis, and a facing pair of accelerating electrodes are electrically connected to every other sheet of the flat plate electrodes 90, and the other facing pair of accelerating electrodes are connected to a different every other sheet of flat plate electrodes 90. In the constitution as described above, a surface current flows through the shortest path, so that the resistance component R becomes minimum and a high value of Q is expected. The value of Q is expressed as $Q=2\pi fL/R$.

In the following, a charged particle accelerator 38 according to the third embodiment will be explained based on FIG. 8.

In the charged particle accelerator 38, for the elements which are common with those in the charged particle accelerators 18 and 36 the same symbols will be used and the detailed explanations on them will be omitted.

The distinctive points in the charged particle accelerator 38 according to the third embodiment are that on both side surfaces of the metallic plates 26*a* and 26*b*, a plurality of flanges 39 having cylindrical metallic fin structures are provided, and the side surfaces of the metallic plates 26*a* and 26*b* are made to be in corrugated forms. In this case, flanges 39 are disposed not to touch the flanges on the adjacent metallic plates 25*a* and 26*b*.

The static capacitance can be increased further and the resonant frequency is lowered by adopting the constitution as described above, which contributes to the realization of a small-sized RFQ for heavy ions. The constitution is designed utilizing a constitution of a vacuum capacitor.

It is also effective to cut a plurality of ring-shaped grooves on the surfaces of the metallic plates 26*a* and 26*b*.

Further, in the charged particle accelerator 38, supports 30 and 30 which support the metallic plates 26*a* and 26*b* are supported to be adjustable to move in the direction of the center axis of the container 19.

In other words, a block 40 which supports a support 30 is fitted in the dovetail groove to be freely slidable in the direction of the center axis, and on all blocks, except the one positioned at the left end, female screws of different pitches 41*a*, 41*b*, --- are cut. A shaft 45 provided with male screw members 43*a*, 43*b*, ---, to be engaged with the female screws 41*a*, 41*b*, --is inserted into the blocks.

Therefore, the distances between the metallic plates 26*a* and 26*b* can be changed keeping equal distances to each other.

In this case, a position adjusting mechanism 46 is constituted which makes the metallic plates 26*a* and 26*b* movable in the direction of the center axis of the container 19 with the blocks 40, the female screws 41*a* and 41*b*, male screw members 43*a* and 43*b* and a shaft 45, etc.

In the case of the charged particle accelerator 38 having the constitution as described in the above, a resonant frequency can be raised by widening the gaps between the metallic plates 26*a* and 26*b* with the net result being it is made possible to adjust a final accelerating energy to an arbitrary value in a very simple manner.

The charged particle accelerators according to the first to the third embodiments as explained in the above are constituted as described in the above. Owing to such constitutions they exhibit the effects as described in the following.

1. It is made possible to offer a heavy ion accelerator having a small size for its resonant frequency in comparison with a conventional RFQ.

This is because of the increase in static capacitance owing to the function of the metallic plates 26*a*, 26*b*, 2. Accelerating faculties are higher in comparison with those of a conventional RFQ. In other words, input power can be saved, that is, Q value of the accelerating cavity is higher.

This is because of the constitution in which a capacitor is formed in the central portion of an accelerating cavity, which makes the path length of a current in the container portion minimum and the current which is generated in a resonant mode, with the result the resistance component in the circuit becomes minimum.

3. The ion accelerating energy can be varied properly in stepless regulation in comparison with a conventional RFQ.

This is because of the fact that the interval dimensions between the metal plates 26*a*, 26*b*, can be properly adjusted by the position adjusting mechanism 46 or the spacers 32 and 33.

An irregular resonant mode is difficult to occur in comparison with a conventional RFQ.

This is because of the reason that a dipole mode which makes a beam trajectory unstable is suppressed due to the fact that the opposing quadrupole electrodes are made equipotential through the metallic plates 26*a* and 26*b*.

Next, a fourth embodiment and a fifth embodiment, in which the fourth embodiment is applied to a gas laser apparatus, will be explained.

Figure 9:
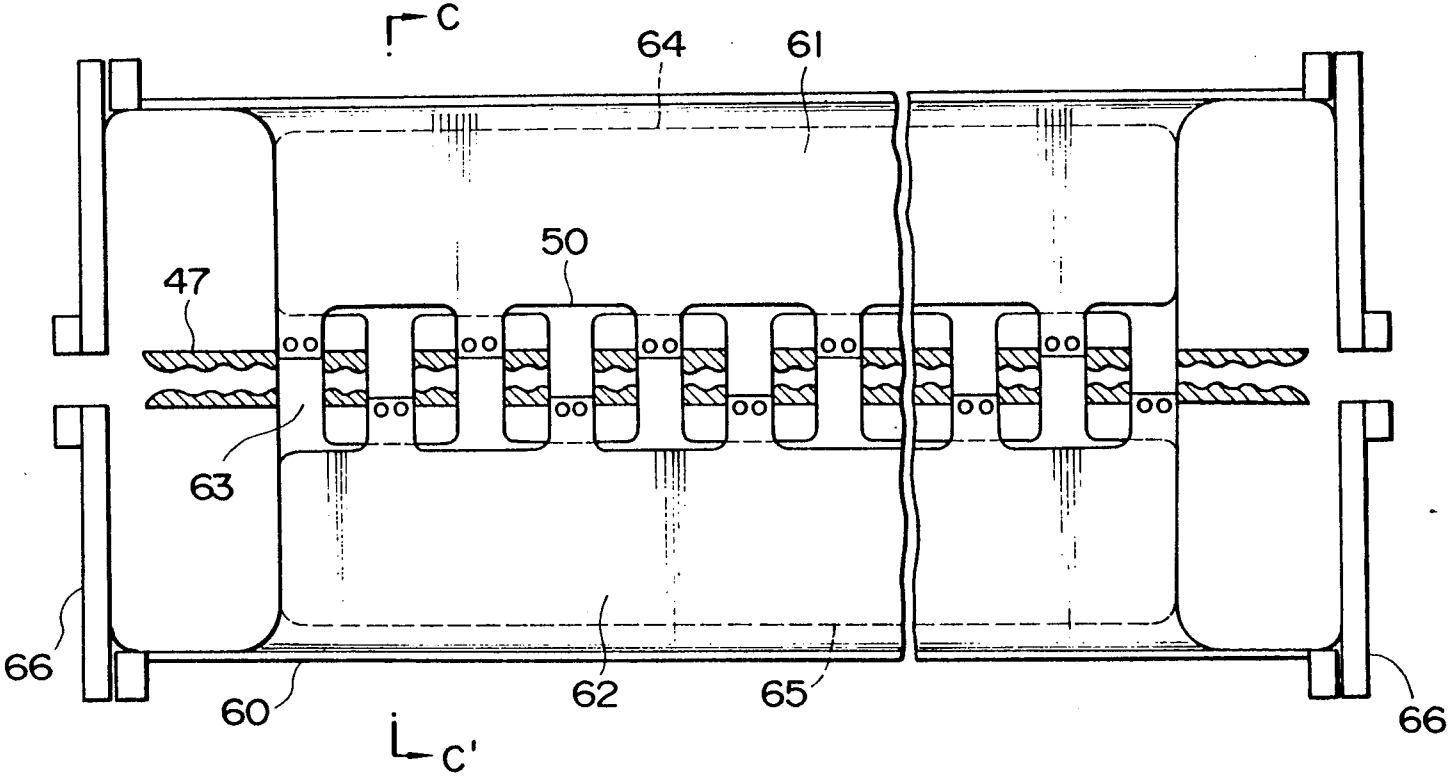
FIG. 9 is a side constitutional diagram of a charged particle accelerator according to yet another embodiment of the present invention.
Figure 10:
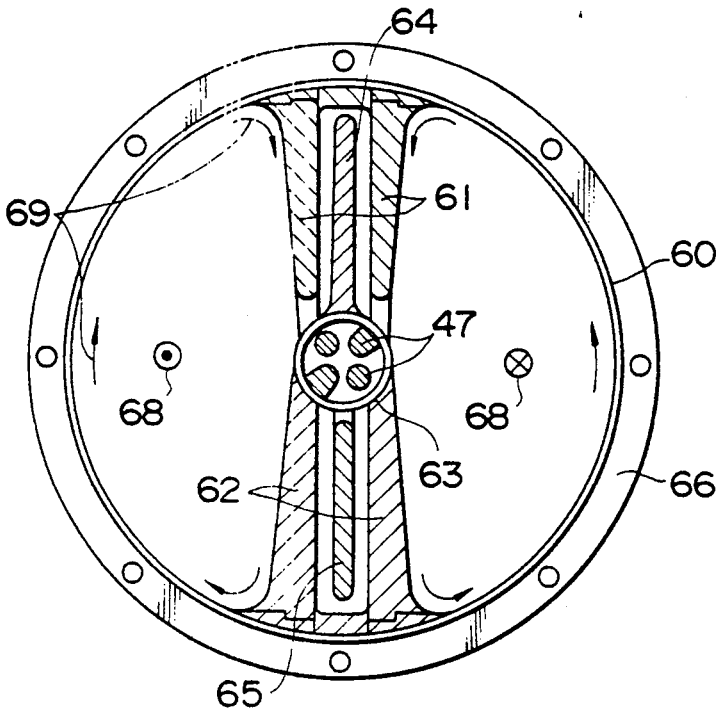
FIG. 10 is a sectional view taken on line C—C' in FIG. 9.
Figure 11:
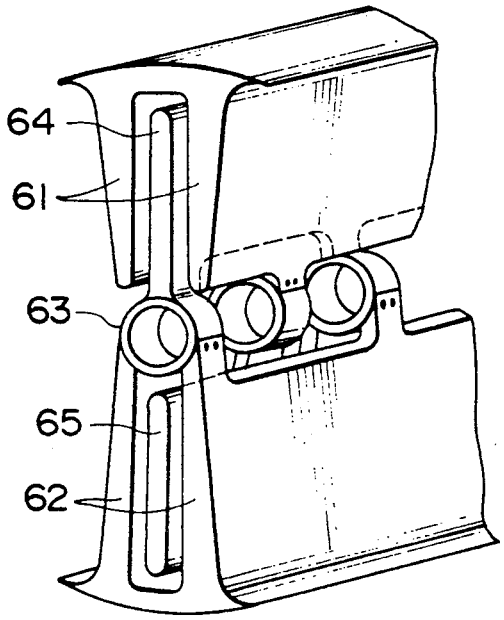
FIG. 11 is a perspective view of a principal portion seen from the C—C' sectional portion in FIG. 10.
Figure 12:
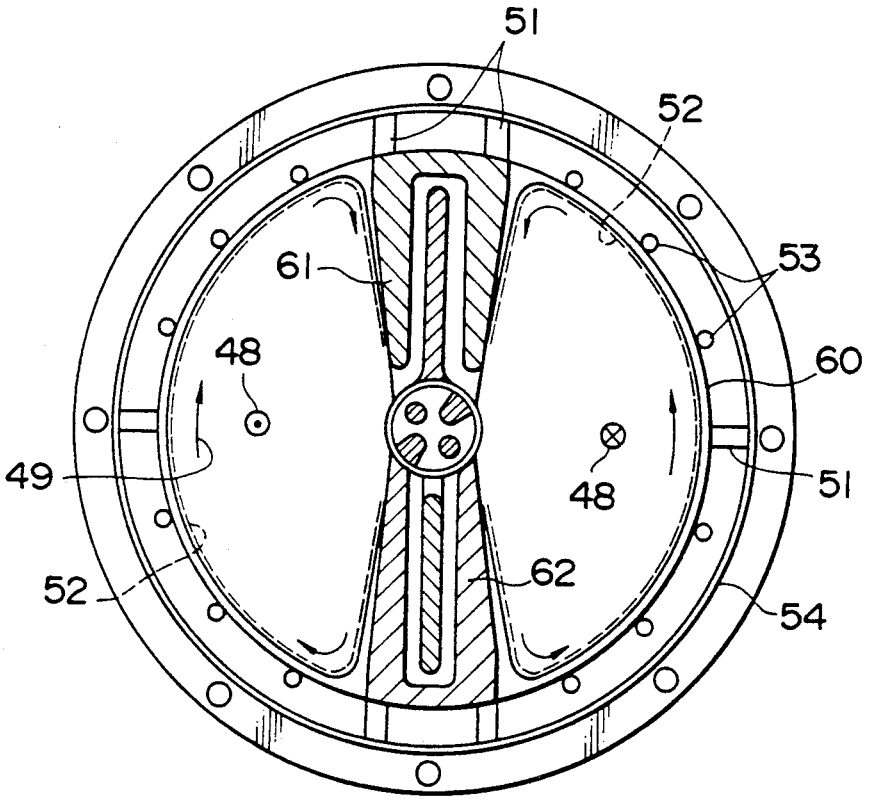
FIG. 12 is a sectional view of a charged particle accelerator in which the inner wall of a cavity is covered with a superconductive material.
Figure 13:
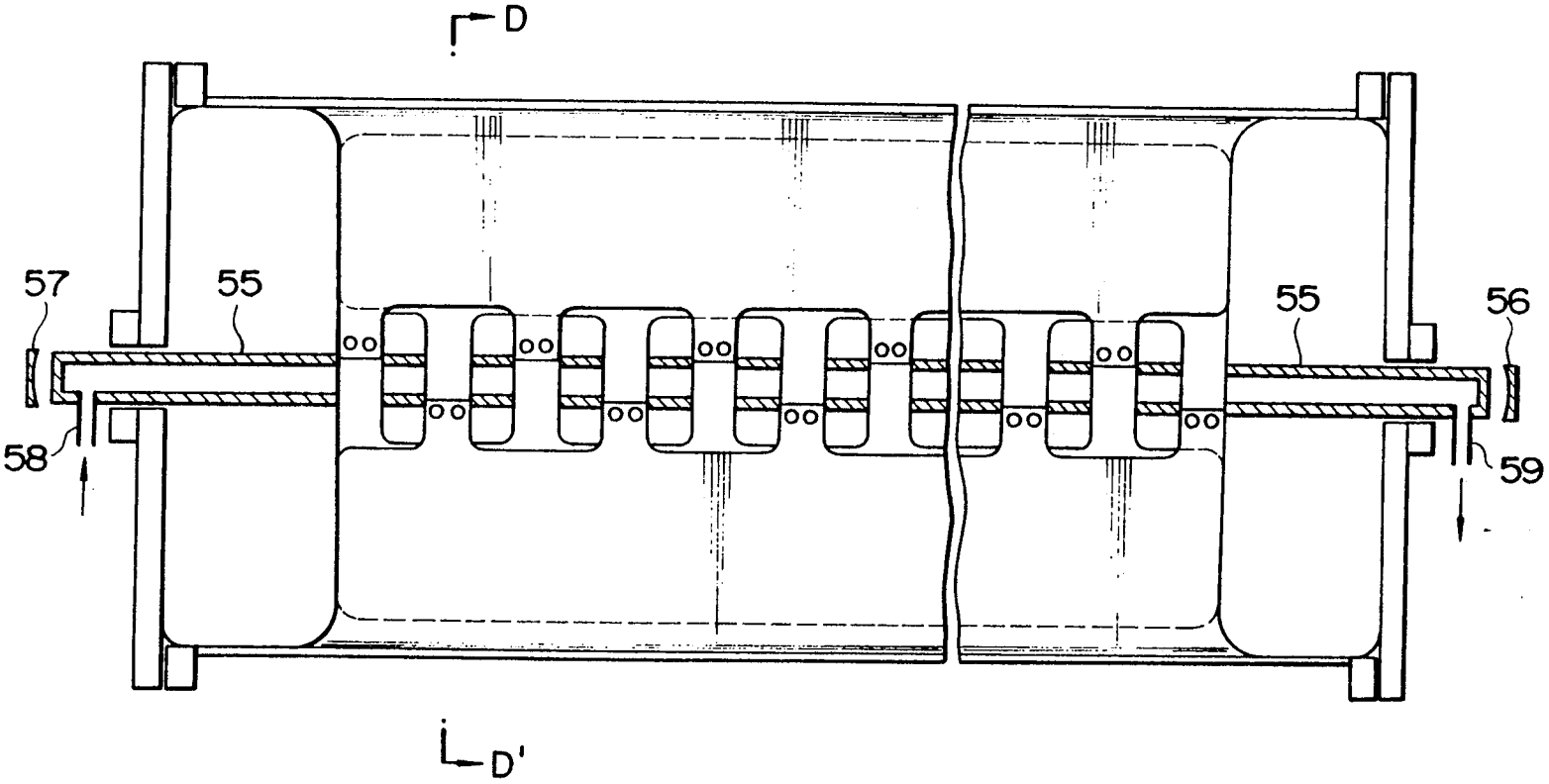
FIG. 13 is a side constitutional diagram of an example in which a charged particle accelerator in an embodiment is applied to a gas laser apparatus.
Figure 14:
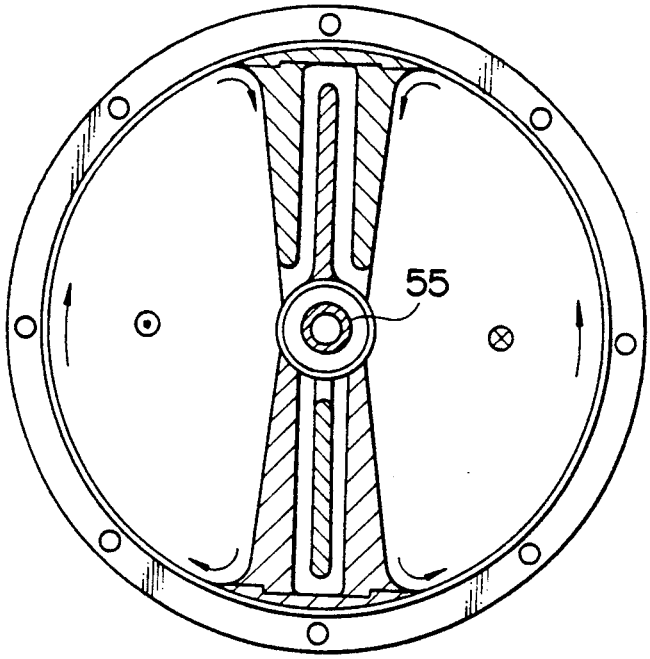
FIG. 14 is a sectional view taken on line D—D' in FIG. 13.
Figure 15:
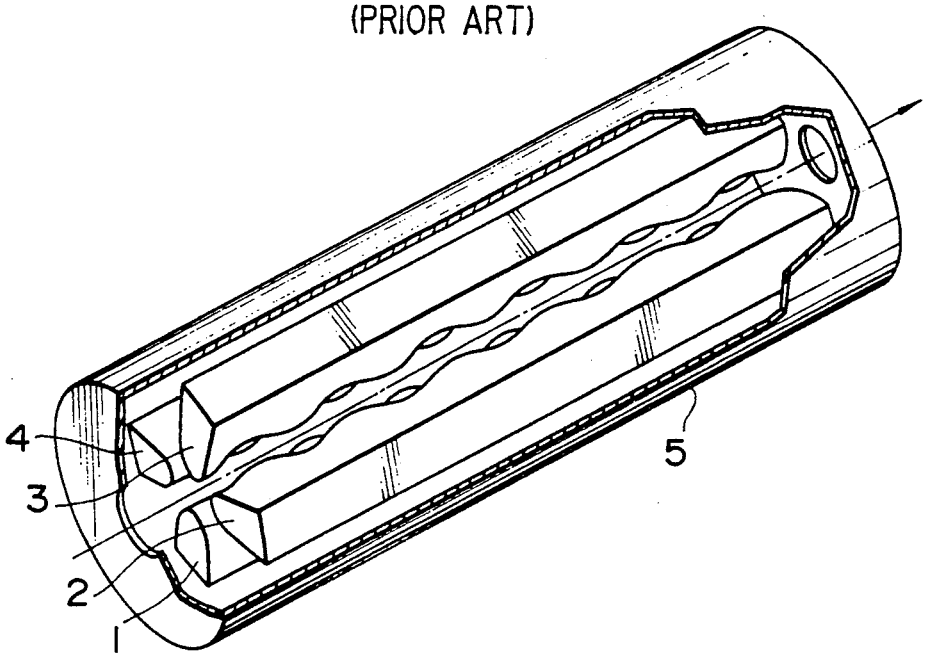
FIG. 15 (PRIOR ART)
FIG. 15 is a perspective view, with a portion broken away, showing the constitution of a conventional RFQ ion accelerator.
Figure 16:
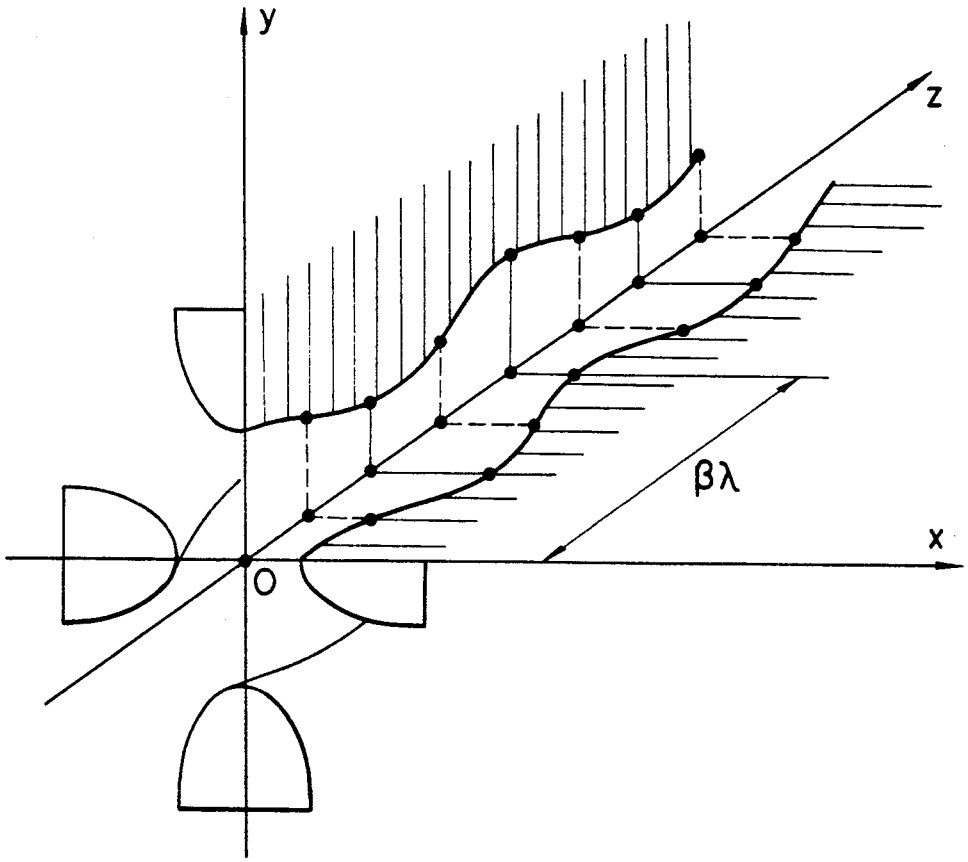
FIG. 16 (PRIOR ART)
FIG. 16 is a representation showing the electrode constitution of quadruple electrodes in FIG. 15.
Figure 17A:
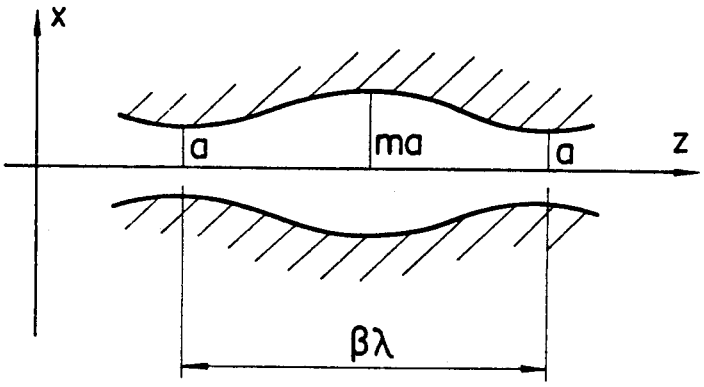
FIG. 17(a) (PRIOR ART)
FIG. 17(*a*) and 17(*b*) are representations showing positional relations among quadrupole electrodes in a sectional view.
Figure 17B:
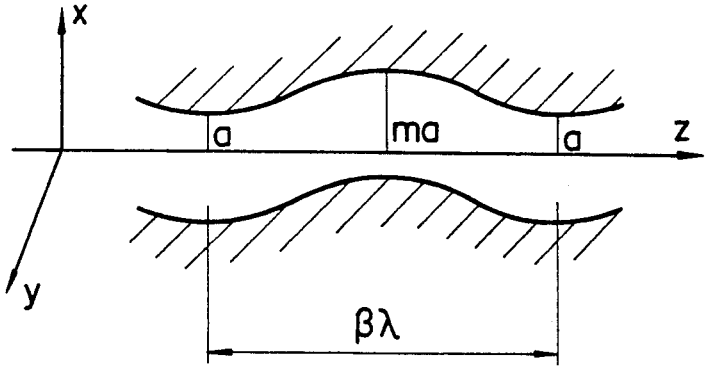
FIG. 17(b) (PRIOR ART)

FIG. 9 is a longitudinal sectional view, FIG. 10 is a sectional view taken on line C—C' in FIG. 9, FIG. 11 is a perspective view showing a partial constitution seen from the section taken on line C—C' in FIG. 9, FIG. 12 is a lateral sectional view of an example in which the cavity inner wall is covered with a superconductive material, FIG. 13 is a longitudinal sectional view of the fifth embodiment in which the fourth embodiment is applied to a gas laser apparatus, and FIG. 14 is a sectional view taken on line D—D' in FIG. 13.

FIG. 9 and FIG. 10 show a concrete example of an accelerator whose resonant frequency is about 13 MHz and the Q value is more than 6000: pairs of flat plate electrodes 61 and 62 are protruded in parallel to the center axis from the opposing surfaces of the inner wall of a cylinder-formed cavity main body 60 having a diameter of about 50 cm diameter, and the tips of the flat electrodes are fixed to the fixing parts 63 for accelerating electrodes having ring-shaped forms. Intermediate electrodes 64 and 65 are fixed to the fixing parts 63 for accelerating electrodes, and they are disposed between the opposing flat plate electrodes 61 and 62 keeping the gaps of 5 mm. The structure of the flat plate electrodes having intermediate electrodes between them is repeated turning upper side and lower side in the direction of the center axis as shown in FIG. 9. Therefore, a sufficient static capacitance is obtained with the constitution in which flat plate electrodes 61 and 62 go into the opposite sides mutually at the opening port portions 50.

The end portions of the cavity main body 60 are closed by conductive flanges 66 and 66, and when the cavity main body 60, flat plate electrodes 61 and 62, and intermediate electrodes 64 and 65 are formed with copper, the Q value of the cavity of more than 6000 can be obtained; thus the specification necessary for the acceleration of heavy ions with practical dimensions can be obtained.

The basic mode of the resonator is a $TE_{110}$ mode, and the lines of magnetic flux 68 penetrate both sides of the flat plate electrodes 61 and 62 and the flat plate electrodes 61 and 62 are disposed in parallel to the center axis and the space in the sectional area of the cavity except the area occupied by the thickness of electrodes and the gaps is given to the lines of magnetic flux 68, so that the maximum inductance L can be secured.

The surface current 69 which flows on the inner wall of the cavity flows between the flat electrodes 61 and 62, which oppose each other with respect to the center axis, through the surface of the cylinder cavity, and the connection points between the flat electrodes 61 and 62, and the inner wall of the cavity main body 60 can be completely connected with metallic parts such as RF contacts, so that the resistance component can be lowered sufficiently.

FIG. 12 shows an embodiment in which the above-mentioned accelerator is improved with superconductive technology: the inner wall of the cavity main body 60 and the outer wall of the flat plate electrodes 61 and 62 of an accelerator having the constitution as described in the above are covered with a high temperature superconductive material 52 or with plates coated with a high temperature superconductive material, and liquid nitrogen is passed in a cooling pipe 53 disposed on the outer wall of the cavity main body 60 for cooling, and also the whole body of the resonant cavity is supported and fixed in the cylindrical vacuum container 54 with a heat insulator, superinsulator 51.

When the apparatus is developed with a superconductive material, the resistance component is much lowered and a Q value of more than 10,000 can be expected, and an accelerator of extremely high power efficiency can be realized.

A charged particle accelerator according to the fourth embodiment shown in FIG. 7 to FIG. 10 being constituted as mentioned above, exhibits effectiveness as described below.

1. The manufacture and assembling of a cavity is easy, and as the positions of respective constitution members can be securely fixed, the accelerating electrodes 47 can be disposed precisely.

2. The number of flat electrodes 41 and 42 laminated in the vicinity of the center axis is made an odd number, so that the change in static capacitance due to the degree of the position preciseness of the intermediate electrodes 44 and 45 or due to the displacement caused by force majeure in the first order is canceled and becomes a small value; thereby the change in the resonant frequency due to the degree of the assembling precision or mechanical vibration can be made small enough, which makes it possible to obtain stable operation.

3. The space in the lateral sectional area of the cavity through which the lines of magnetic flux pass can be secured to a maximum, so that maximum inductance can be obtained; the surface current path length can be made minimum, so that the resistance component can be made small and a high Q value is obtained. This means that input power P is converted to electrode voltages effectively, in other words, it shows that the performance of an apparatus as an accelerator is high.

4. Since the flat plate electrodes 41 and 42 are disposed in parallel to the center axis, a comparatively large static capacitance C can be obtained without decreasing the value of inductance. It shows that a a low frequency resonance is obtained, that is, it shows that high frequency acceleration of heavy ions is made possible.

5. The superconductive technology is easily introduced by covering the inner wall of a cavity with a superconductive material or with a plate 52 coated by a superconductive material, which makes it possible to obtain a charged particle accelerator of better power efficiency.

In the above-mentioned charged particle accelerator according to the fourth embodiment, when a pipe made of a material of low dielectric constant for introducing an arbitrary gas into it is disposed in the position of the quadrupole electrodes 47 being disposed on the center axis and a high frequency power is supplied to a resonant cavity constituted with the flat plate electrodes 61 and 62, and the cavity main body 60, plasma can be generated by the high frequency discharge in the arbitrary gas introduced into the pipe disposed in the central portion of the resonant cavity. The apparatus can be utilized as a plasma CVD apparatus or as a gas laser apparatus by properly selecting the kind of gas to be introduced into the pipe. A concrete example will be shown in the following.

In FIG. 13 and FIG. 14, the fifth embodiment is shown in which a charged particle accelerator according to the fourth embodiment is applied to a gas laser apparatus. In place of quadrupole electrodes 47 disposed in the vicinity of the center axis of the resonant cavity as shown in FIG. 9 and FIG. 10, a quartz pipe 55, a low dielectric constant material, is disposed in the position of the center axis, and a gas such as helium gas which can be a laser medium is introduced into the pipe through a supply port 58 and a discharge port 59; in this state, when high frequency power is supplied to the resonant cavity, a plasma condition is generated in the medium gas introduced into the quartz pipe 55, and the medium gas is excited to generate laser light of a wave length inherent to the medium gas. When an optical oscillator of Fabry-Perot type is constituted by providing concave mirrors 56 and 57 on both ends of the quartz pipe 55, a laser oscillation is generated by induced emission, and a laser light can be radiated to the outside by making either one of the concave mirror 56 or 57 a half mirror.

The above-mentioned gas laser apparatus utilizes a resonant cavity which constitutes a charged particle accelerator having a high Q value according to the fourth embodiment, so that the gas laser apparatus can be the one of high power efficiency.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A charged particle accelerator in which an arbitrary kind of charged particles is accelerated to an arbitrary energy level in passing said charged particles through quadrupole electrodes disposed in the direction of a center axis inside a cylinder-shaped container by supplying a specified potential to said quadrupole electrodes from a resonant circuit composed of a capacitor and an inductor, wherein said capacitor comprises a plurality of conductive metallic plates disposed along the center axis at specified intervals in the vicinity of said quadrupole electrodes inside said container, said inductor comprises said container and a plurality of conductive metallic supports for supporting said metallic plates and being directly connected to said container, and said metallic plates are electrically directly connected to said quadrupole electrodes.

2. A charged particle accelerator according to claim 1, wherein the metallic supports for supporting said metallic plates are alternately directly connected to opposite side portions of said container of said container inside said container for giving rise to an electromagnetic field corresponding to a $TE_{110}$ mode.

3. A charged particle accelerator according to claim 1, wherein the metallic supports for supporting said metallic plates are alternately directly connected to the inside of said container in 2 directions. making 90 degrees with each other for giving rise to electromagnetic field corresponding to a $TE_{210}$ mode.

4. A charged particle accelerator in which an arbitrary kind of charged particles is accelerated to an arbitrary energy level in passing said charged particles through quadrupole electrodes disposed in the direction of a center axis inside a cylinder-shaped container by supplying a specified potential to said quadrupole electrodes from a resonant circuit composed of a capacitor and an inductor, wherein said capacitor comprises a plurality of conductive metallic plates disposed along the center axis at specified intervals in the vicinity of said quadrupole electrodes inside said container, said inductor comprises said container and a plurality of conductive metallic supports for supporting said metallic plates and being directly connected to said container, said metallic plates are electrically directly connected to said quadrupole electrodes, and a position adjusting mechanism making said metallic plates movable in the center axis direction of said container is provided.

5. A charged particle accelerator according to claim 1 or to claim 4, comprising a plurality of flanges of metallic cylinder-shaped fin structure provided on respective side surfaces of said plurality of metallic plates for, making said side surfaces have corrugated forms, wherein respective flanges of said adjacent metallic plates aré disposed not to touch each other.

6. A charged particle accelerator in which an arbitrary kind of charged particles is accelerated to an arbitrary energy level in passing said charged particles through quadrupole electrodes disposed in the direction of a center axis inside a cylinder-shaped container by supplying a specified potential to said quadrupole electrodes from a resonant circuit composed of a capacitor and an inductor, wherein said capacitor comprises flat plate electrodes which are protruded from opposing both side surfaces of the inner wall of said container toward respective opposing sides and are disposed in parallel to the center axis in such a manner as for making side surfaces thereof close to each other at specified intervals, said inductor comprises said flat plate electrodes and said container connected to said flat electrodes, and said flat plate electrodes are electrically directly connected to said quadrupole electrodes.

7. A charged particle accelerator according to claim 6, wherein said flat plate electrodes protruded from opposing surfaces on both sides of the inner wall of said container toward respective opposite sides are disposed close to each other and are composed of flat plate electrodes of an odd number.

8. A charged particle accelerator according to claim 6, wherein each pair of quadrupole electrodes positioned on a diagonal line disposed around the center axis are electrically directly connected to said flat plate electrodes on each side.

9. A charged particle accelerator according to claim 6, wherein the inner wall of said container and the surfaces of said flat electrodes are covered with a superconductive material and a cooling means is provided on said container.

* * * * *